United States Patent [19]

Hammonds et al.

[11] Patent Number: 4,586,844

[45] Date of Patent: May 6, 1986

[54] HYBRID SCAFFOLDING ASSEMBLY

[75] Inventors: James W. Hammonds, Angleton; James E. Wheeler, Clute, both of Tex.

[73] Assignee: The Dow Chemical Company, Midland, Mich.

[21] Appl. No.: 595,007

[22] Filed: Mar. 29, 1984

[51] Int. Cl.[4] ..... F16B 1/00; F16B 7/04

[52] U.S. Cl. ..... 403/287; 403/301; 403/349; 403/49; 182/178; 248/159

[58] Field of Search ..... 403/287, 286, 292, 299, 403/301, 306, 348, 349, 298, 49; 182/178; 248/159

[56] References Cited

U.S. PATENT DOCUMENTS

| | | | |
|---|---|---|---|
| 2,110,158 | 3/1938 | Keeler | 403/348 X |
| 2,703,724 | 3/1955 | Der Yuen et al. | 403/292 X |
| 2,988,318 | 6/1961 | Ferguson et al. | 403/306 X |
| 3,000,656 | 9/1961 | Hollaender | 403/292 X |
| 3,395,501 | 8/1968 | Davidson, Jr. et al. | 183/178 |
| 3,506,090 | 4/1970 | Beziat | 183/178 |
| 3,752,262 | 9/1973 | Helms | 183/178 X |
| 3,759,623 | 9/1973 | Hesse | 403/298 |
| 3,869,218 | 3/1975 | Stoeber et al. | 403/349 X |
| 3,902,817 | 9/1975 | Meir | 182/178 X |

*Primary Examiner*—Cornelius J. Husar
*Assistant Examiner*—Todd G. Williams
*Attorney, Agent, or Firm*—Melvin William Barrow

[57] ABSTRACT

A hybrid scaffold assembly which employs a scaffold adaptor for transferring from a Tube Lox type of scaffolding to a stack-up type of scaffolding and vice versa.

6 Claims, 8 Drawing Figures

HYBRID SCAFFOLDING ASSEMBLY

BACKGROUND OF THE INVENTION

This invention relates to metal tubular scaffolds. More particularly it relates to adapting one type of such scaffolding to another type of such tubular scaffolding members.

Generally, in the past there have been two types of metal tubular scaffolding used. The first type is referred to in the trade as the "stack-up" type of scaffolding. This type is adapted for quick erection. However, it is limited in that is usually is built in pre-fabricated panels. These panels are not amenable to fitting through overhead steam lines and the like as the scaffold panels are stacked one atop the other to form a scaffold which must go above the steam line.

The second type of metal tubular scaffolding is known in the trade as the "tube lox" type. This tube lox scaffolding type is available from the Harsco Corporation, a corporation of Delaware. This tube lox type is not built in panels as are the stack-up type. Hence, the tube lox type of scaffolding is more versatile in assembling a scaffold in different configurations to fit around objects than the stack-up type. However, this tube lox type takes more time to assemble than does the stack-up type.

It would be advantageous to be able to transfer from one of these two types of metal tubular scaffolding to the other. Until the present, however, it has been the practice of those in the scaffolding industry to choose either one or the other of these two types of scaffolding for a particular scaffolding job, but not both types in the same scaffold. This has been done because the two different types of scaffolding employ different kinds of couplings to join the scaffold tubes in an end-to-end connective arrangement.

The coupling means which is employed normally by those in the trade using stack-up type scaffolding is one in which a removeable male coupling connector is fitted inside the ends of two tubes. This male connector is secured to both the tubes by a first removeable pin passing through holes in the first tube as well as through a hole in the part of the removeable male connector which is fitted inside the end of the first tube, and which is also connected by a second removeable pin which passes through holes in the second tube and a hole in that part of the removeable male connector which is fitted inside the second tube. This type of coupling means is illustrated in a scattered manner in the figures of the drawing. Therein a removeable male pin-type connector is denoted by reference numeral 18, a stack-up type scaffold tubing by reference numeral 12, a lower portion of a second stack-up type scaffold tubing by reference numeral 56, holes in the first tubing by reference numbers 34 and 36, holes in the second tubing by reference numbers 52 and 54, holes in the removeable pin-type male coupling connector 18 denoted by numbers 30, 32, a connecting pin by reference number 42, and a bolt serving as a connecting pin is denoted by reference number 38.

Note that there is not present in any one drawing two regular stack up type scaffolding tubes jointed end-to-end by a male coupling connector. This is because these drawings are illustrative of this invention in which there is either a transfer from stack up type scaffolding tubing to the tube lox type scaffolding, or a transfer from tube lox type scaffolding to stack-up type scaffolding as a scaffold is upwardly assembled.

The coupling means known for joining a first conventional tube lox scaffolding tube to a second one in an end-to-end fashion is a rotational type male in female coupling. This male-female rotational type coupling is also illustrated in the drawings. A particular type of rotational male coupling member is denoted by reference numeral 66 in FIGS. 1 and 5. A particular type of rotational female coupling means is denoted by reference numerals 80, 82, 84 and 88 in FIGS. 2, 4, and 5.

The pin-type coupling means has traditionally been used with prefabricated scaffold panels wherein several scaffolding tubes are permanently joined together into panels as illustrated by 106, 108, 110 in FIG. 7. On the other hand the rotational type coupling means has traditionally been used with non-prefabricated scaffolding tubes.

Since both scaffold tube types have their advantages and disadvantages; and since it has long been the convention in the scaffolding industry to choose either one type or the other, but not both, for any one scaffold assembly; and since there are occassions when it would be advantageous to use both scaffold tube types in a given scaffolding assembly; therefore, the present invention provides the scaffolding industry with such a scaffolding assembly, i.e. a hybrid of both scaffold tube types.

SUMMARY OF THE INVENTION

The present invention provides a hybrid scaffold assembly which allows conversion from one known type of prefabricated scaffolding tube to another known type of prefabricated scaffolding tube in the same scaffold assembly. One type of such scaffolding assembly is the type which employs a removable, pin-type, male coupling connector to join the scaffold tubing when the scaffold tubing is joined together vertically in an end-to-end fashion. In this type of known scaffold tubing, both of the ends of each scaffold tube are of the female type with the male coupling connector being inserted into one end of each tube to join them together. The two ends of each of these tubes are secured to the male coupling connector by pins or bolts which are easily slid through corresponding holes in them.

The other known type of scaffolding tubing employs a rotational male-female coupling instead of the slip-in and pin male-female couping described immediately above. In this type of scaffold tubing the male rotational coupling part of the male-female rotational coupling is fixedly attached to one end of the scaffolding tube, usually the upper end, and the female rotational coupling part is fixedly attached at the other end.

The present invention provides a scaffold adaptor which allows one of these two known types of scaffold tubes to be mounted above and secured to the end of the other type of scaffold tubing in one scaffold assembly.

BRIEF DESCRIPTION OF THE DRAWING

The present invention will be better understood by reference to the drawing wherein like parts are referred to by the same reference numerals in the several figures, and wherein.

DETAILED DESCRIPTION OF THE PREFERRED EMBODIMENTS

Figure 1:
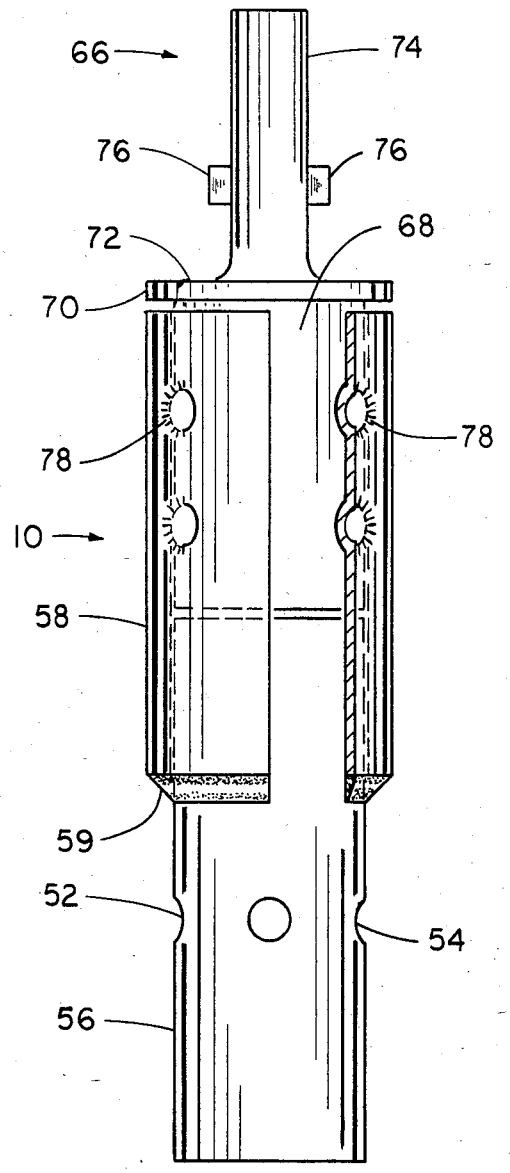
FIG. 1 is a partially cut-away, side view of a stack-up to tube lox scaffold adaptor 10 for building up from a lower stack-up scaffolding tube type 12 to an upper tube lox type of scaffolding tube 14.
Figure 2:
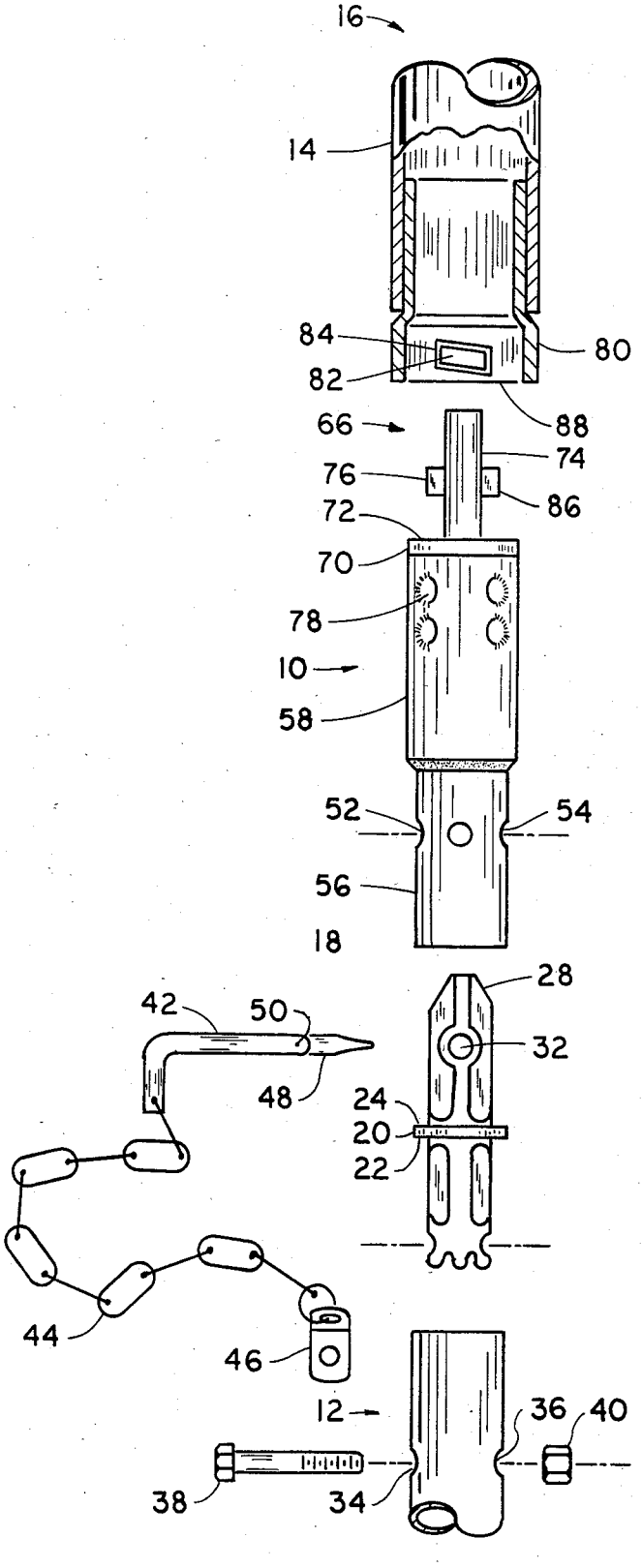
FIG. 2 is an exploded side view, partially cut away, of scaffold adaptor 10 of FIG. 1 connecting a lower stack-up type scaffolding tube 12 and its associated removeable pin-type male coupling connector 18 with an upper tube lox type of scaffolding tube 14.
Figure 3:
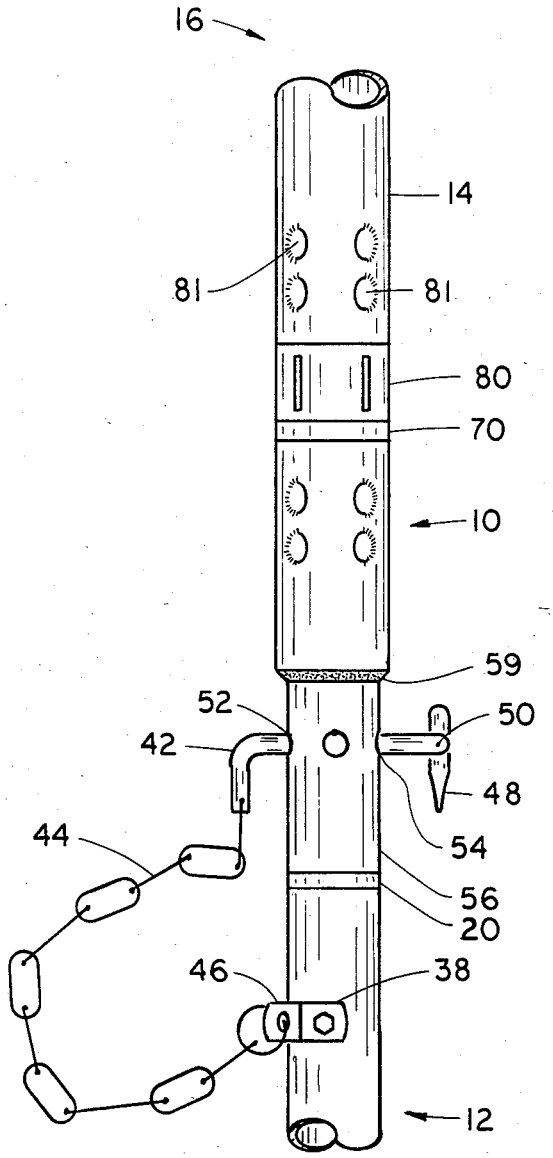
FIG. 3 is a side view of the assembled parts of FIG. 2.

The Embodiment in FIGS. 1, 2 and 3

In FIGS. 1, 2 and 3 is illustrated a scaffold adaptor 10 for transferring from a stack-up type of scaffolding tube 12 to a tube lox type of scaffolding tube 14 to form a hybrid scaffolding assembly 16. In FIGS. 2 and 3 the stack-up type of scaffolding tube 12 is the lower scaffolding tube in the hybrid scaffolding assembly 16.

Associated with scaffolding tube 12 is a removeable, pin-type, male coupling connector 18. Connector 18 has a shoulder 20 which extends radially outward from it. Shoulder 20 has a lower face 22 and an upper face 24 which serve as the weight bearing faces for the weight transmitted downwardly from the upper, or tube lox, scaffold tubing 14, through adaptor 10, and onto lower or stack-up type scaffold tubing 12.

Removeable pin-type male connector 18 has a hole 30 extending traversely through its lower part 26 and a hole 32 extending traversely through its upper part 28. Its lower part 26 extends downwardly into the upper part of hollow scaffold tube 12 until the lower face 22 of its shoulder 20 rests on the top of tube 12. Scaffold tube 12 has two holes 34 and 36 on opposite sides of it which are aligned with hole 30 in the lower part 12 of the removeable male coupling connector 18. Bolt 38 passes through these thru aligned holes 34, 30 and 36 to secure the removeable male coupling connector 18 within scaffold tubing 12. Bolt 38 is secured in place by nut 40. Bolt 38 serves as a pin for the pin-type removeable male coupling connector 18 in its lower part 26. Locking pin 42 serves as the pin for the upper part 28 of the pin-type removeable male coupling connector 18. Pin 42 is attached for convenience to bolt 38 by chain 44 and chain catch 46. Pin 42 has a retainer blade 48 in its end which swivels about pivot pin 50 into a recessed portion (not shown) in the pin body 42. When inserting pin 42 retainer blade 48 is rotated about pivot pin 50 until it is aligned with pin 42 so that pin 42 can pass through hole 32, among other holes. After passage through these holes, retainer blade 50 will fall out of alignment with pin 42, as shown in FIG. 3, due to its being pivoted about pin 50 at a point which is removed from its center of gravity. Blade 48 is made this way so that pin 42 can be quickly inserted and quickly removed from aligned holes when desired to do so, but yet will remain in place in the holes until it is desired to remove it.

The other holes through which pin 42 passes are holes 52, 54 located in the lower tubular member 56 of the scaffold adaptor 10.

Figure 7:
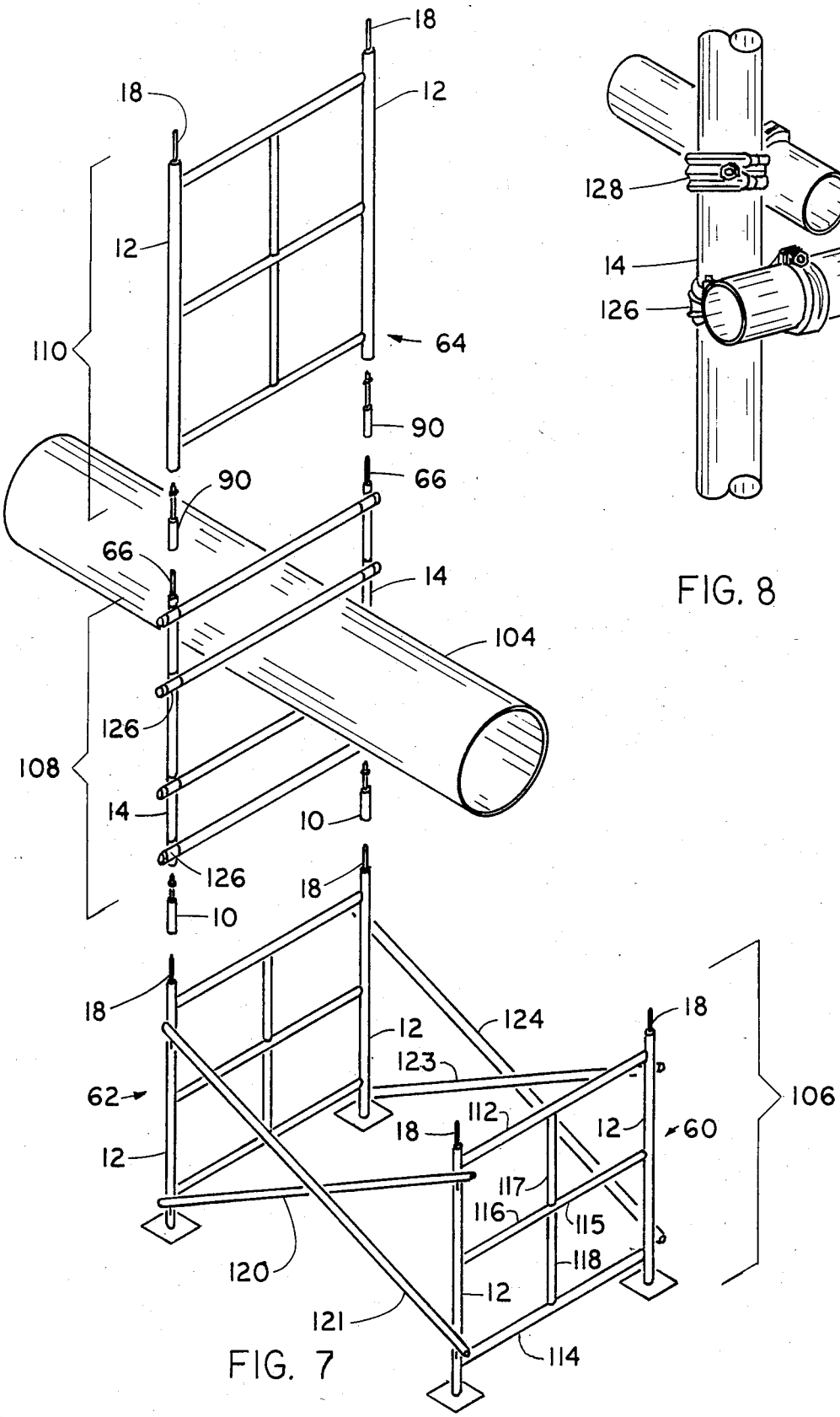
FIG. 7 is an isometric view of a scaffolding assembly going from a stack-up type scaffolding panel tier 106 as the bottom scaffold tier, up to the start of a second tier 108 of tube box type scaffolding fitted around a pipe 104 around which a conventional stack-up type scaffolding tier will not fit, and on up to a stack-up type scaffolding panel 64 which is to become a part of the third tier 110 of the assembly upon which other stack-up type tiers can be quickly assembled.

Scaffold adaptor 10 (see FIG. 1 particularly) has a lower tubular member 56 and an upper tubular member 58. Lower tubular member 56 is joined to upper tubular member 58 by welds 59. Lower tubular member 56 has the same diameter as does the stack-up type of scaffolding tube 12 so that it can snugly fit over and around the upper part 28 of male coupling connector 18 and rest upon the upper face 24 of the male coupling connector's shoulder 20. The diameter of the adaptor's upper tubular member 58 is larger than the diameter of the adaptor's lower tubular member 56 because the adaptor's upper member 58 is made to be the same diameter as that of the upper scaffolding tube 14, (i.e. a tub lox type of scaffolding tube) shown in FIGS. 2 and 3. Tube lox scaffolding tubes are generally larger in diameter than are stack-up scaffolding tubes because stack-up scaffolding tubes are made in panels of tubes which are welded together and which would, therefrom, pose a weight problem for those assembling a scaffold employing it if they were not made of lighter tubing. Such stack-up type scaffold panels are shown in FIG. 7 wherein they are ascribed reference numerals 60, 62 and 64.

Referring back to FIGS. 1, 2 and 3, the scaffold adaptor's lower tubular member 56 is seen to have holes 52, 54 in it. When lower tubular member 56 is fitted over and around the upper part 28 of male coupling 18 of FIG. 2 as shown in FIG. 3 with the bottom rim of member 56 resting on the upper face 24 of shoulder 20, then holes 52 and 54 are located so that they will be aligned on opposing ends of hole 32 of male coupling connector 18 (FIG. 2). When so aligned, then pin 42 is inserted through holes 52, 32 and 54 and prevents scaffold adaptor 10 from being accidently pulled apart from the lower scaffolding tube 12.

Returning again to FIG. 1, the upper tubular member 58 of scaffold adaptor 10 is seen to have a solid, cast iron rotational male coupling member 66 permanently affixed inside it as well as extending upwardly from it. Rotational male coupling member 66 has a lower part 68, a collar 70 with a weight bearing upper face 72, and an upper smaller diameter mating part 74 with mating projections 76 extending radially outwardly from it. Rotational male coupling member 66 is permanently affixed to the scaffold adaptor's upper tube 58 by indentures 78 which are pressed into the surfaces of upper tube 58 and the male coupling member's lower part 68 to squeeze the two together permanently. Rotational coupling member's elements 72, 74 and 76 are designed to matingly engage the rotational female coupling means permanently fitted inside the lower end of the tube lox scaffold tube 14 (or upper scaffolding tube 14) in FIGS. 2 and 3.

This female coupling means includes short tube 80 which necks down to fit inside tube 14. Tube 80 is permanently affixed to tube 14 by indentures 81 (FIG. 3) which are pressed into their surfaces. This female coupling means also a pair of opposing shoulders 82 (FIG. 2, one not shown) which are welded inside short tube 80 and which have an upper sloping face 84. Sloping shoulder 82 is welded so that when short tube 80 is pushed down and around upper male mating part 74 and is rotated thereabout, then the lower surfaces 86 of projections 76 engage the upper surfaces 84 of sloping shoulder 80 and pull the upper tube 14 and the scaffold adaptor together, the rotation continuing until the lower surface 88 of short tube 88 and the upper face 72 of collar 70 can come no closer together. In this condition the friction between the upper face 84 of shoulder 82 and the lower surface 86 of projections 76 combine with the friction between the upper face 72 of shoulder 70 and the lower surface 88 of short tube 80 to secure the upper tube 14 to the scaffold adaptor 10 and, consequently, to the lower stack-up type of scaffold tubing 12.

Figure 4:
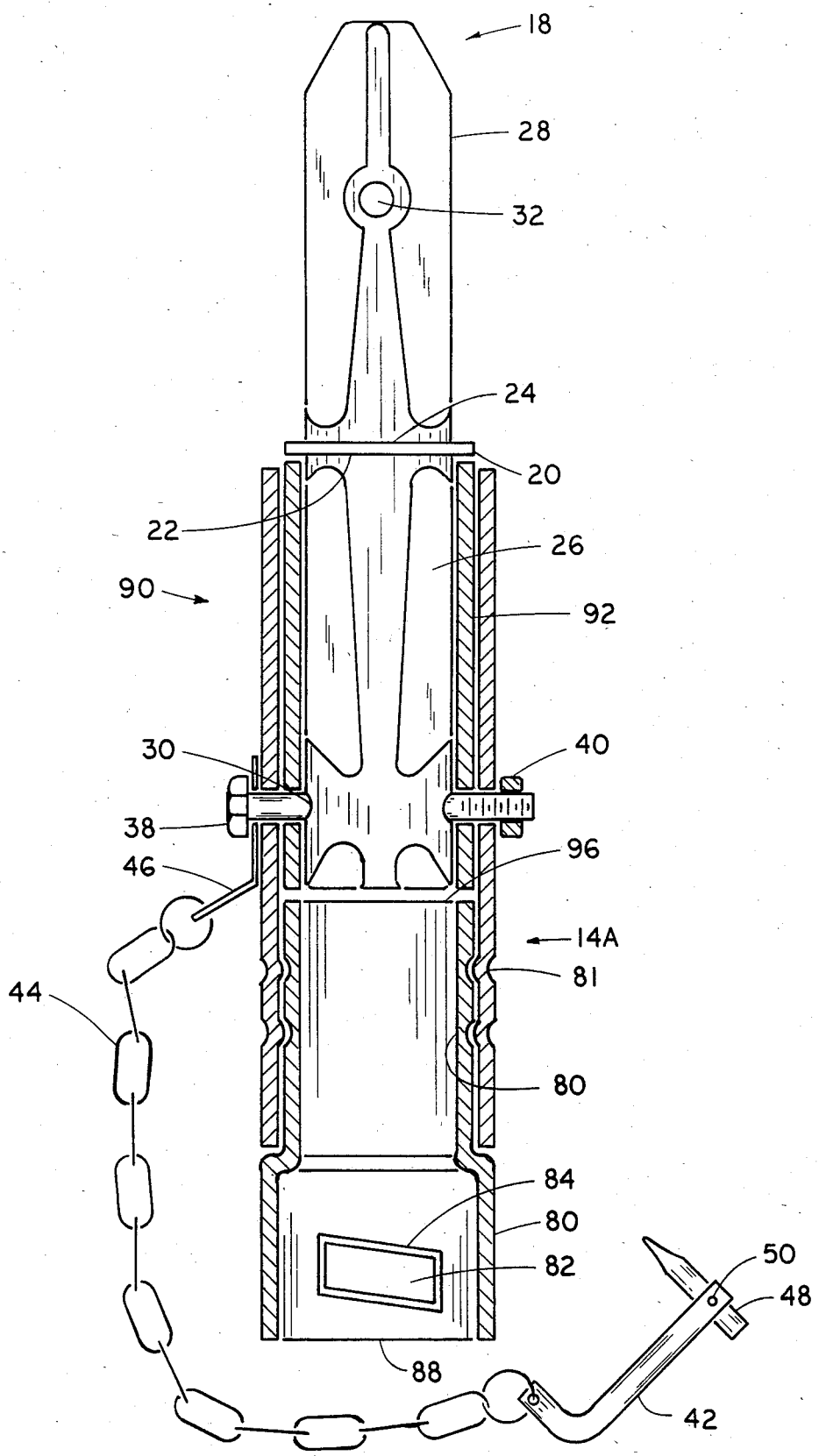
FIG. 4 is a sectional side view of a tube lox to stack-up scaffold adaptor assembly 90 for going from a lower tube lox scaffolding tube 14 to an upper stack-up type of scaffolding tube 12 which has a smaller diameter than the lower tube lox tube.
Figure 5:
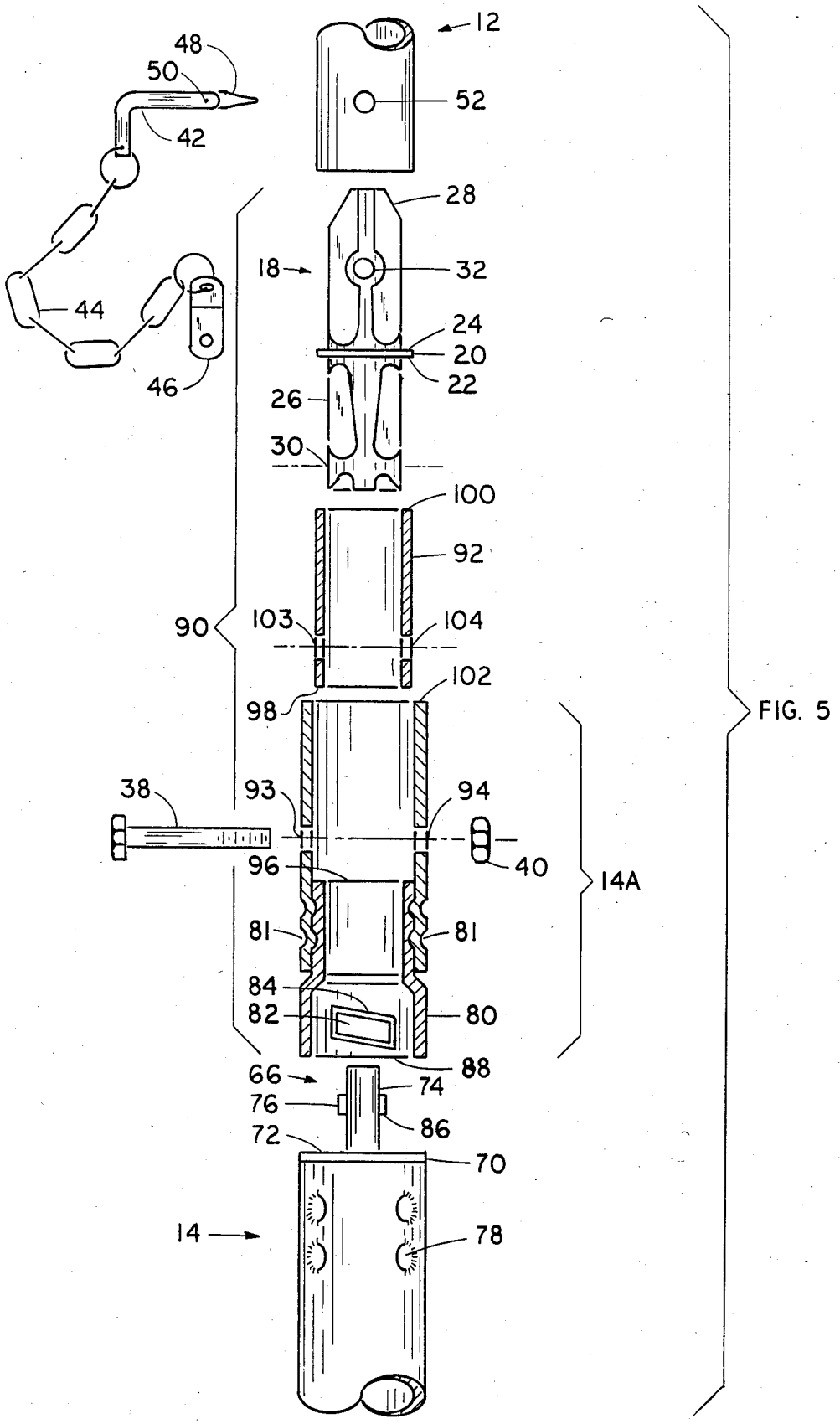
FIG. 5 is an exploded side view, taken partially in section, of the adaptor of FIG. 4 connecting a lower conventional tube lox scaffolding tube 14 to an upper, pin-connector type, stack-up type of scaffolding tube 12.
Figure 6:
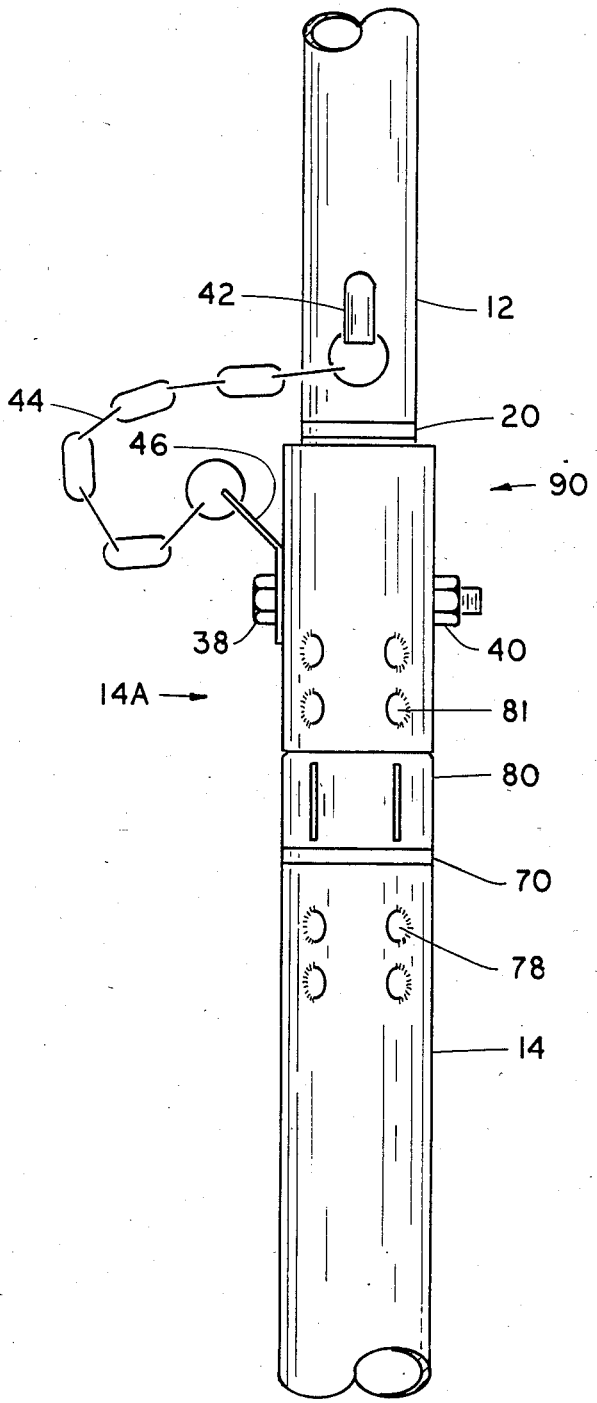
FIG. 6 is an assembled view of the parts of FIG. 5.

The Embodiment in FIGS. 4, 5 and 6

In FIGS. 4, 5 and 6 there is disclosed a scaffold adaptor 90 for transferring from a tube lox type of scaffolding tube (i.e. from a rotational male-female coupling type scaffold tube) as the lower scaffolding tube 14 up to a stack-up type of scaffolding tube (i.e. a removeable pin type coupling connector scaffolding tube) as the upper scaffolding tube 12. Note that the upper and lower scaffolding tubes 14 and 12, respectively are reversed from the positions they had in FIGS. 1, 2 and 3. Note, however, that the male coupling members are still the ones which are at the top end of their respective scaffold tubes; this is the preferred manner used in erecting scaffolds of multiple tiers. Further note that the same reference numerals and names are used for the same parts in these three figures as were used in FIGS. 1, 2, and 3 when the parts are the same but only the arrangement is different. And finally note that again the diameter of the stack-up type of scaffolding tube 12 is again smaller in diameter than the diameter of the tube lox type of scaffolding tube 14.

The scaffold adaptor 90 is comprised of three parts: (a) a lower part 14*a* which is in reality only the lower part of a modified tube lox type of scaffolding tube with the same type of female coupling means described above in the discussion of normal length tube lox tube 14 of FIGS. 1, 2 and 3; (b) a removeable pin-type male coupling connector 18 like the one described above in the discussion of the embodiment of FIGS. 1, 2 and 3; and (c) a tube sleeve 92.

Other than having a shortened lower portion of a normal length tube lox tube with a rotational female coupling means, the modification made to this lower part of the lower part 14*a* of the tube lox type of scaffolding adaptor is the addition of holes 93 and 94 (FIG. 5). These two holes are located so as to be aligned with the hole 30 in the removeable male pin-type coupling connector's lower part 26 when it is properly fitted inside the upper part of tube 14*a*. For the embodiment shown, the proper fitting of this male coupling connector's lower part 26 requires tube sleeve 92 to be properly fitted within the upper part of tube 14*a*.

Sleeve 92 is used to transmit the weight load of male connector 18 from its shoulder 20 to the upper edge 96 of short tube 80. It is also used to fill the space between the male coupling 18 and the upper portion of tube box tubing 14*a* of adaptor 90. Therefore, to carry out the first of these functions, sleeve 92 is made sufficiently long so that its bottom edge 98 rests on the top edge 96 of short tube 80 while its top edge 100 extends upwardly far enough above the top 102 of tubing 14*a* to contact the lower face 22 of removeable pin-type male coupling connector's shoulder 20. Tube sleeve 92 has two opposed holes 103 and 104 which are alignable with holes 93 and 94 in the shortened tube lox tubing 14*a* and with male coupling connector hole 30 when the sleeve's bottom edge 98 is resting upon the short tube's upper edge 96 so that bolt 38 and nut 40 pin together the removeable male coupling connector 18, the tube sleeve 92, and the lower part 14*a* of the rotational male-female coupling tube which contains the female coupling means. In this manner scaffold adaptor 90 is assembled and ready for use.

Scaffold adaptor 90 is used by first rotating it, and necessarily, its rotational female coupling means 80, 82, 84, 88, about the rotational male coupling member 66 which includes elements 74, 76, 86, 72, and which extends upwardly from the normal length of rotational coupling type of scaffold tubing 14, the lower tubing in FIGS. 5 and 6. Next the upper scaffolding tube 12 in FIGS. 5 and 6 is secured to the top of the scaffold adaptor 90 by installing the lower part of stack-up type scaffolding tube 12 over and around the upper part of male connector 18 and inserting pin 42 through holes 52, 32 and 54 as described above in the discussion of these parts for FIGS. 1, 2 and 3.

Figure 8:
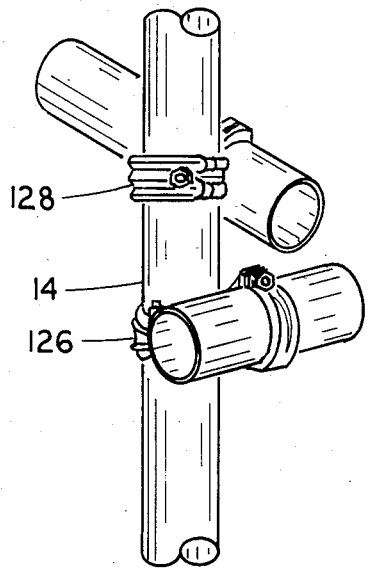
FIG. 8 is an isometric view of fragmented, tube lox scaffold tubing connected by clamps 126, 128 to illustrate how this type of tubing is connected to each other when not connected in an end-to-end relationship.

Discussion of FIGS. 7 and 8

FIG. 7 shows a particular circumstance in which the present invention is useful. In this circumstance there is a scaffold job for which quick assembly using stack-up type scaffolding is desired. However, in the way of such there is pipe 104 directly in the path of the scaffold as it would be erected from the ground-up. Until the advent of the present invention the presence of this pipe would dictate to those of ordinary skill in the art that the slower assemblying, tube lox type of scaffolding be used for the total job. However, with the scaffold adaptors 10 and 90 discussed above the slower tube lox scaffold tubing 14 need be use only to build around pipe 104 while using the faster assembled, stack-up type of scaffold tubing 12 above and below pipe 104.

As mentioned above scaffolds are assembled in tiers and the stack-up type of scaffolding tubing 12 is often made into prefabricated panels. In FIG. 7, three such panels 60, 62, and 64 are shown. Panel 60 is made up of two upright scaffold tubes 12 and 12 welded together with tubes 112, 114, 115, 116, 117 and 118. Panels 62 and 64 are likewise made from like welded pipes.

The bottom scaffold tier 106 is completed by connecting panels 60 and 62 with tubing 120, 121, 123 and 124.

The second scaffold tier 108 is shown not yet completed, but is has not prefabricated panels to connect together. It must be assembled by connecting each indivdidual scaffold tubing together with clamps such as rigid right angle clamps 12 and flexible clamp 128 shown in FIG. 8.

Upon completion tier 108 will resemble tier 106 to the extent that it occupies a certain three dimensional section immediately above tier 106 and is made of connected scaffold tubing.

After completion of scaffold tier 108, scaffold tier 110 will be quickly assembled by adding panel 64 and a like panel (not shown) to the tops of the ends of tier 108 and connecting these two tiers 108, 110 with structural tubing in a like manner as was done with panels 60 and 62 of tier 106.

We claim:

1. A hybrid scaffolding assembly (16) which is comprised of (A) a lower scaffolding tube (12); (B) a removable, pin-type, male coupling connector (18); (C) an upper scaffolding tube 14; and (D) a scaffold adaptor (10);

(A) said lower scaffolding tube (12) being substantially vertically oriented and having a pair of horizontally aligned holes (34, 36) on opposite sides of it;

(B) said removable, pin-type, male coupling connector 18 having a lower part (26) which extends downwardly into the top of said tube (12) and an upper part (28) which extends upwardly from the top of said tube (12), said removable, pin-type, male coupling connector (18) having a shoulder (20) which extends laterally outwardly from about its middle with said shoulder having an upper face (24) and a lower face (22), said lower face (22) resting on the top of said lower scaffolding tube (12) and being the weight bearing surface for said lower part (26) of said removable, pin-type, male coupling connector (18), said upper face (24) of said shoulder (20) being adapted to be the weight bearing surface for said upper part (28) of said removable, pin-type, male coupling connector (18), said removable, pin-type, male coupling connector 818) having a first hole (30) extending transversely through its lower part (26) and a second hole (32) extending transversely through its upper part (28), said hole (30) being aligned with said two holes (34, 36) in said lower scaffolding tube (12), and said aligned holes (30, 34, 36) having a removable pinning means (38) passing therethrough to prevent said lower part (26) of said removable, pin-type, male coupling connector (18) from being removed from the inside of said lower scaffold tubing (12) while said pinning means (38) is in place;

(C) said upper scaffolding tube (14) being also substantially vertically oriented and positioned at a spaced distance above said lower scaffolding tube (12) and being vertically in line therewith, said upper scaffolding tube (14) having a rotational female coupling means (80, 82) permanently fitted at its lower end, said rotational female coupling means 80, 82 being adapted to receive a rotational male coupling member (66);

(D) said scaffold adaptor (10) being interposed between said upper and lower scaffolding tubes 14 and (12), respectively, said scaffold adaptor (10) being comprised of a lower tubular member (56) welded to the lower end of an upper tubular member (58), and a rotational male coupling member (66) which has a lower solid part (68) and an upper solid part (74) which is smaller in diameter than said lower solid part (68), said lower solid part (68) being permanently affixed in said upper tubular member (58) of said scaffold adaptor (10), said upper solid part (74) extending upwardly from said upper tubular member (58) of said scaffold adaptor (10), said lower tubular member (56) being fitted over and around said upper part (28) of said removable, pin-type, male connecting member (18) with the bottom edge of said lower tubular member (56) resting on said weight bearing upper face (24) of said shoulder (20) of said removable, pin-type, male coupling connector (18), said lower tubular member (56) of said scaffold adaptor (10) having two holes (52, 54) in opposite sides of it in a manner so that they are aligned with said hole (32) which extends transversely through said upper part (28) of said removable, pin-type, male coupling connector 18, there being a removable pin (42) passing through these three aligned holes (52, 32, 54) to prevent said lower tubular member (56) of said scaffold adaptor (10) from becoming inadvertently disconnected from said lower scaffolding tube (12) while in service, said male rotational member (66) having mating projections (76) extending outwardly from said upper solid part (74), said member 66 being inserted into and matingly engaged with the female couple means (80, 82) of said upper scaffolding tube (14).

2. The hybrid scaffolding assembly (16) of claim 1 wherein the diameter of said upper scaffolding tube (14) is greater than the diameter of said lower scaffolding tube (12), wherein the diameter of said lower tubular member (56) of said scaffold adaptor (10) is the same as the diameter of said lower scaffolding tube (12), and wherein the diameter of said upper tubular member (58) of said scaffold adaptor (10) is the same as the diameter of said upper scaffolding tube (14).

3. The hybrid scaffolding assembly (16) of claim 2 wherein said lower scaffolding tube (12) is part of a panel (60) of scaffolding tubes (112, 114, 116, 118) which are rigidly and permanently welded together.

4. A hybrid scaffolding assembly which is comprised of (A) a lower scaffolding tube (14); (B) a scaffold adaptor (90); and (C) an upper scaffolding tube (12);

(A) said lower scaffolding tube (14) being substantially vertically oriented and having a rotational male coupling member (66) permanently affixed to and extending upwardly from its upper end, said rotational male coupling member (66) having mating projections (76) extending laterally from it;

(B) said scaffold adaptor (90) being positioned above said lower scaffolding tube (14), said scaffold adaptor (90) being comprised of the lower part (**14*a*) of a scaffold tubing (14), said lower part (14*a*) containing a rotational female coupling means (80, 82) permanently fitted inside of it, said rotational female coupling means (80, 82) being matingly engaged with said rotational male coupling member (66) of said lower scaffolding tube (14), said scaffold adaptor (90) being further comprised of a removable, pin-type, male coupling connector (18), said removable, pin-type, male coupling connector (18) itself being comprised of an upper part (28), a lower part (26), and a collar (20) near its center, said collar having an upper weight bearing face (24) and a lower weight bearing face (22), said lower part (26) having a pinning hole (30**) through it, said upper art (28) having a pinning hole (32) through it, and said lower part (26) being fitted and pinned inside of the top portion of said lower part of said adaptor, and (C) Said upper scaffold tube (12) being vertically oriented above the scaffold adaptor (90), said upper tube (12) having its lower part fitted around the upper part (28) of said removable, pin-type, male coupling connector (18), said lower part of said upper scaffolding tube (12) being connected to said removable, pin-type, male coupling connector's upper part (28) by a removable in means (42) which passes through a hole (32) located in said upper part (28) of said removable, pin-type, male connector (18) as well as passing through opposing holes (52) and (54) which are positioned in said lower part of said upper scaffolding tube (12), said opposing holes (52 and 54) being aligned with said hole (32) of said upper part.

5. The hybrid assembly of claim 4 wherein the diameter of said lower scaffolding tube (14) is the same as the diameter of said lower part (14*a*); of said adapter wherein the inside diameter of said lower part (14*a*) of said adapter and the inside diameter of said lower scaffolding tube (14) is greater than the outside diameter of said upper tube (12), and wherein the inside diameter of said upper tube (12) is sufficiently large enough for said upper part (28) of said removable, pin-type, male coupling connector (18) to fit snugly inside of said upper tube (12).

6. The hybrid scaffolding system of claim 4 wherein the diameter of said lower part (26) of said removable, pin-type, male coupling connector (18) is the same as the diameter of said upper part (28) of said removable, pin-type, male coupling connector (18), and said hybrid scaffolding system (90) further comprises a spacing sleeve (92) fitted inside of said lower part (14*a*) of said adaptor (90), said spacing sleeve (92) further fitting around said lower part (26) of said removable, pin-type, male coupling connector (18), said sleeve (92) having holes (103 and 104) in it which align with said opposing holes (93) and (94) in said lower art (14*a*) of said adapter and with said hole (30) in said lower part (26) of said removable, pin-type, male coupling connector (18) in a manner such that a bolt (38) passes through said five aligned holes (93, 103, 30, 104, 94) in order to secure said removable, pin-type, male coupling connector (18) to said lower part (14*a*) of said adaptor.

* * * * *

UNITED STATES PATENT AND TRADEMARK OFFICE

CERTIFICATE OF CORRECTION

PATENT NO. : 4,586,844

DATED : May 6, 1986

INVENTOR(S) : James W. Hammonds and James E. Wheeler

It is certified that error appears in the above-identified patent and that said Letters Patent is hereby corrected as shown below:

Col. 2, line 49; reads "couping", should read --coupling--.

Col. 3, line 22; reads "box", should read --lox--.

Col. 4, line 27; reads "tub", should read --tube--.

Col. 6, line 1; reads "box", should read --lox--.

Col. 6, line 60; reads "is", should read --it--.

Col. 6, line 60; reads "not", should read --no--.

Col. 6, line 62; reads "indivdidual", should read --individual--.

Col. 7, line 36; reads "818)", should read --(18)--.

Col. 7, line 38; after "said" insert --first--.

Col. 9, line 1; reads "art", should read --part--.

Col. 9, line 3; after "part" insert --(14a)--.

Col. 9, line 13; reads "in", should read --pin--.

UNITED STATES PATENT AND TRADEMARK OFFICE

CERTIFICATE OF CORRECTION

PATENT NO. : 4,586,844

DATED : May 6, 1986

INVENTOR(S) : James W. Hammonds et al.

It is certified that error appears in the above-identified patent and that said Letters Patent is hereby corrected as shown below:

Column 10, line 18, reads "art", should read -- part --.

Signed and Sealed this

Twentieth Day of January, 1987

*Attest:*

DONALD J. QUIGG

*Attesting Officer*

*Commissioner of Patents and Trademarks*